US010435971B2

(12) United States Patent
Wubben et al.

(10) Patent No.: US 10,435,971 B2
(45) Date of Patent: Oct. 8, 2019

(54) ANCHOR SYSTEM AND METHOD FOR USE IN A WELLBORE

(71) Applicant: SHELL OIL COMPANY, Houston, TX (US)

(72) Inventors: Antonius Leonardus Maria Wubben, Rijswijk (NL); Tino Walter Van Der Zee, Joure (NL); Remmelt Bouma, Joure (NL); Erik Van Dalfsen, Joure (NL)

(73) Assignee: SHELL OIL COMPANY, Houston, TX (US)

( * ) Notice: Subject to any disclaimer, the term of this patent is extended or adjusted under 35 U.S.C. 154(b) by 198 days.

(21) Appl. No.: 15/529,421

(22) PCT Filed: Dec. 9, 2015

(86) PCT No.: PCT/EP2015/079160

§ 371 (c)(1),
(2) Date: May 24, 2017

(87) PCT Pub. No.: WO2016/091971

PCT Pub. Date: Jun. 16, 2016

(65) Prior Publication Data

US 2017/0328157 A1 Nov. 16, 2017

(30) Foreign Application Priority Data

Dec. 12, 2014 (EP) ..... 14197546

(51) Int. Cl.
*E21B 23/01* (2006.01)
*E21B 43/10* (2006.01)

(52) U.S. Cl.
CPC ..... *E21B 23/01* (2013.01); *E21B 43/103* (2013.01); *E21B 43/105* (2013.01)

(58) Field of Classification Search
CPC ..... E21B 23/01; E21B 43/103; E21B 43/105
See application file for complete search history.

(56) References Cited

U.S. PATENT DOCUMENTS 2,765,855 A 10/1956 Reed
3,677,341 A 7/1972 Burns et al.
(Continued)

FOREIGN PATENT DOCUMENTS

EP 1044316 A1 10/2000
WO 2012104257 A1 8/2012
(Continued)

OTHER PUBLICATIONS

International Search Report and Written Opinion received for PCT Patent Application No. PCT/EP2015/079160, dated Feb. 15, 2016, 10 pages.

(Continued)

*Primary Examiner* — Kristyn A Hall

(57) ABSTRACT

An anchoring system for anchoring a tool (24) in a downhole tubular element (2) comprises: —an anchor (28) having a central body (40) connected to, or integrally formed with, the tool (24); —a slip element (50) radially movable relative to the central body (32) between a retracted and an expanded position against the inner surface of the tubular element (2), —a primary spring (56) for moving the slip element to the expanded position; —a control device comprising a stop member (60) against which the slip element (50) is pushed by the primary spring (56); and —a secondary spring (58) acting on the stop member (60) to move each slip element (50) to its retracted position.

10 Claims, 5 Drawing Sheets

(56) References Cited

U.S. PATENT DOCUMENTS

| | | | |
|---|---|---|---|
| 4,393,931 | A | 7/1983 | Muse et al. |
| 5,878,818 | A | 3/1999 | Hebert et al. |
| 7,131,498 | B2 | 11/2006 | Campo |
| 7,467,671 | B2 | 12/2008 | Savignat et al. |
| 2010/0257913 | A1 | 10/2010 | Storm et al. |
| 2012/0037381 | A1 | 2/2012 | Giroux et al. |
| 2017/0130536 | A1 | 5/2017 | Stam et al. |
| 2017/0145778 | A1 | 5/2017 | Zijsling et al. |
| 2017/0145797 | A1 | 5/2017 | Stam et al. |

FOREIGN PATENT DOCUMENTS

| | | | |
|---|---|---|---|
| WO | 2013172856 | A1 | 11/2013 |
| WO | 2014044630 | A2 | 3/2014 |

OTHER PUBLICATIONS

U.S. Appl. No. 15/503,086, "Assembly and Method for Creating an Expanded Tubular Element in a Borehole", filed Feb. 10, 2017.

ANCHOR SYSTEM AND METHOD FOR USE IN A WELLBORE

CROSS REFERENCE TO EARLIER APPLICATION

This application is a US national stage application of PCT/EP2015/079160, filed 9 Dec. 2015, which claims priority benefits of European Application No. 14197546.6, filed 12 Dec. 2014.

FIELD OF THE INVENTION

The present invention relates to a system for anchoring a tool in a tubular element extending in a borehole formed in an earth formation.

BACKGROUND

Wellbores for the production of hydrocarbon fluid generally are provided with steel casings and/or liners to provide stability to the wellbore wall and to prevent undesired flow of fluid between the wellbore and the surrounding earth formation. A casing generally extends from surface into the wellbore, whereas a liner may extend only a lower portion of the wellbore. However in the present description the terms "casing" and "liner" are used interchangeably and without such intended difference.

In a conventional wellbore, the wellbore is drilled in sections whereby each section is drilled using a drill string that has to be lowered into the wellbore through a previously installed casing. In view thereof the wellbore and the subsequent casing sections decrease in diameter with depth. The production zone of the wellbore therefore has a relatively small diameter in comparison to the upper portion of the wellbore. In view thereof it has been proposed to drill a "mono diameter" wellbore whereby the casing or liner to be installed is radially expanded in the wellbore after lowering to the required depth. Subsequent wellbore sections may therefore be drilled at a diameter larger than in the conventional wellbore. If each casing section is expanded to the same diameter as the previous section, the wellbore diameter may remain substantially constant with depth.

US 2010/0257913 A1 discloses an expansion system whereby an actuator pulls an expansion device through a tubular element. The actuator is anchored in the tubular element by means of an anchor having a resilient anchoring member that is activated by axial compression.

WO 2013/172856 A1 discloses a hydraulic anchoring tool including upper and lower slip systems for use in either cased or open hole wellbores. The tool is activated by hydraulic pressure in a work string.

It is a drawback of the known hydraulic anchoring tool that, when the anchor is to be deactivated for example to displace the anchor in axial direction, there may still be a high fluid pressure in the workstring after releasing the hydraulic pressure at surface. This may result in high contact forces between the slips and the inner surface of a tubular element against which the slips are anchored, and may cause damage to the the inner surface or coating applied to the inner surface.

U.S. Pat. Nos. 4,393,931; 3,677,341; 5,878,818 and 2,765,855 and US patent application US2012/037381 disclose other known anchoring tools that may damage the downhole tubular and/or cannot be released therefrom after deactivation.

SUMMARY

In accordance with invention there is provided an anchor system for anchoring a tool in a tubular element extending in an underground borehole, the system comprising an anchor adapted to be arranged in the tubular element, the anchor including:

a central body connected to the tool or integrally formed with the tool;

a slip element radially movable relative to the central body between a retracted position and an expanded position whereby the slip element is expanded against the inner surface of the tubular element;

primary spring means arranged to induce movement of the slip element to the expanded position;

a control device for controlling movement of the slip element induced by the spring means, which control device comprises a stop member against which the slip element is pushed by the primary spring means, the stop member being movable in correspondence with movement of the slip element between the retracted position and the expanded position; and secondary spring means acting on the stop member so as to induce movement of the slip element to the retracted position.

The invention also provides a method of anchoring a tool in a tubular element extending in a borehole formed in an earth formation, wherein use is made of an anchor system as defined above.

BRIEF DESCRIPTION OF THE DRAWINGS

The invention will be described hereinafter by way of example in more detail with reference to the accompanying drawings in which.

In the detailed description and the drawings, like reference numerals relate to like components.

DETAILED DESCRIPTION

Figure 1:
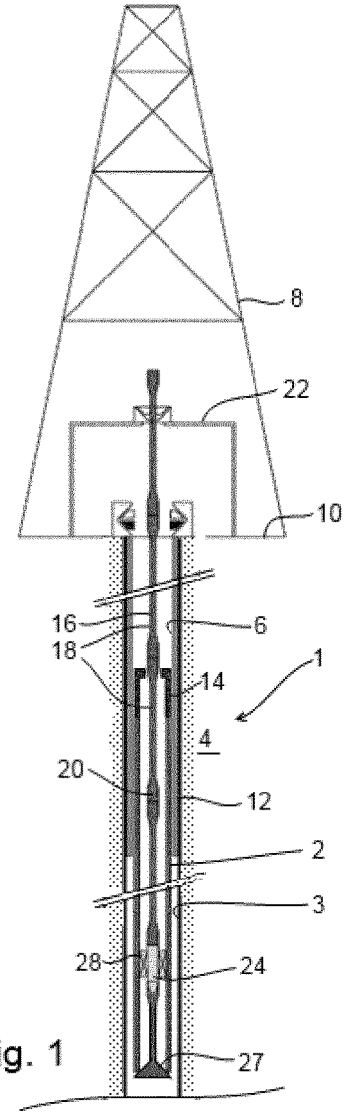
FIG. 1 schematically shows an embodiment of the system of the invention at the onset of expansion of a tubular element in a wellbore.

Described is an anchor system for anchoring a tool in a tubular element, which has one or more slip elements radially movable relative to a central body. The maximum activation force and thus contact force between each slip element and the inner surface of the tubular element is governed by spring means rather than by hydraulic pressure in a workstring. Thereby the risk of damage to the inner surface of the tubular element, or to the coating on the inner surface, during resetting the anchor is minimised.

Advantageously the resulting spring force acting on the slip element may induce the slip element to move to the retracted position.

Suitably the primary spring means comprises a primary compression spring and the secondary spring means comprises a secondary compression spring, the secondary compression spring having a higher pre-load than the primary compression spring when the slip element is in the retracted position.

The control device may comprise a hydraulic actuator arranged to control movement of the stop member.

Suitably the central body is included in an elongate string extending from surface into the tubular element, wherein the hydraulic actuator is adapted to be operated by a hydraulic control system at surface via a fluid channel extending in the elongate string.

The tool to be anchored may be adapted to be operated by the hydraulic control system at surface via the fluid channel extending in the elongate string.

In an advantageous application the tubular element is a radially expandable tubular element, and said tool comprises a jack device for pulling an expander through the tubular element so as to radially expand the tubular element.

To enable the full length of the tubular element to be expanded, suitably a cage is positioned above the tubular element, the cage being surrounded by a cylindrical wall and being adapted to receive the anchor and to be radially expanded by the anchor against said cylindrical wall.

The cage may comprise a plurality of slip elements and, for each slip element, a respective slip extension member arranged to be moved by the slip element in radially outward direction against the cylindrical wall.

Referring to FIGS. 1-4 there is shown a system 1 for expanding a tubular element 2 in a borehole 3 formed in an earth formation 4. The borehole 3 may be a wellbore for the production of hydrocarbon fluid. An expandable casing 6 extends from a drilling rig 8 at surface 10 into the borehole 3 whereby the lower end of the casing is positioned at an intermediate depth of the borehole 3. The tubular element 2 is arranged in a deeper section of the borehole 3 whereby an upper end part of the tubular element 2 extends into a lower end part of the casing 6 to form a short overlap section 12. A cylindrical cage 14 is temporarily connected to the top of the tubular element 2, as will be referred to hereinafter.

Figures 5A, 5B:
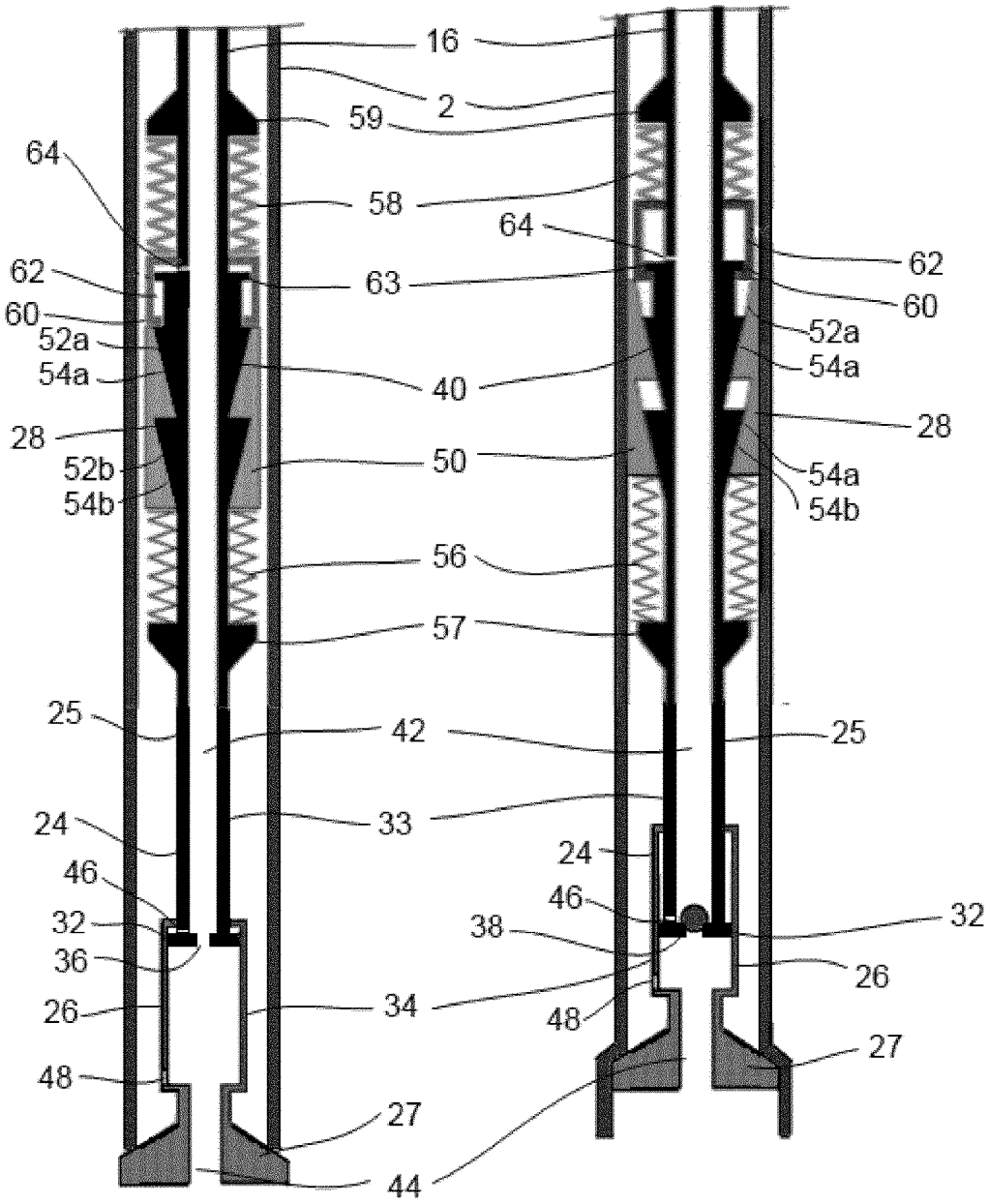
FIGS. 5*a-e* schematically show the anchor used in the embodiment during various stages of the expansion process.

An expansion string 16 formed of drill pipe sections 18 interconnected by pipe connectors 20, extends from a rig floor 22 on the drilling rig 8 into the casing 6 and further into the tubular element 2. The expansion string 16 includes a hydraulic jack device 24 with telescoping upper and lower members 25, 26 (FIG. 5*a*). The telescoping lower member 26 is connected to an expander 27 for radially expanding the tubular element 2. The expander 27 is initially positioned just below the lower end of the tubular element 2. The telescoping upper member 25 is provided with an anchor 28 for anchoring the jack device 24 to the tubular element 2 so as to allow the jack device 24 to pull the expander 27 through the tubular element 2. At the onset of the expansion process the jack device 24 is stroked out.

Referring further to FIGS. 5*a-e* there is shown the jack device 24 with the anchor 28 in more detail during various stages of operation. The jack device 24 is formed as a piston/cylinder assembly whereby telescoping upper member 25 includes a piston 32 and a mandrel 33. Telescoping lower member 26 includes a cylinder 34 into which the piston 32 is arranged. The piston 32 is provided with a through bore 36 adapted to be closed by a plug 38 (FIGS. 5*b-e*). The mandrel 33 is connected to, or integrally formed with, a central body 40 of the anchor 28. A fluid channel 42 extends through the telescoping upper member 30, the central body 40 and the drill pipe sections 18 to a hydraulic control system (not shown) at surface. The expander 27 is provided with a flow passage 44 that provides fluid communication between the cylinder 34 and the borehole 3 below the expander. The mandrel 33 is provided with a side opening 46 to allow hydraulic fluid to be pumped from the fluid channel 42 into the cylinder 34. Further, the cylinder 34 has a side opening 48 for venting fluid from, or drawing fluid into, the cylinder while the piston 32 moves through the cylinder.

The anchor 28 comprises a plurality of slip elements 50 circumferentially spaced around the central body 40 of the anchor. Each slip element 50 has tapering inner surfaces 52*a*, 52*b* that are in contact with respective tapering outer surfaces 54*a*, 54*b* of the central body 40. The inner and outer surfaces 52*a*, 52*b*, 54*a*, 54*b* have identical taper angles. Furthermore, each slip element 50 is arranged to slide in axial direction along the tapering outer surfaces 54*a*, 54*b* of the central body 40. Due to the taper angles of the surfaces, the slip element 50 is in a radially retracted mode when at a lower position relative to the central body 40, and in a radially expanded mode when at an upper position relative to the central body 40. In the radially expanded mode the slip element 50 contacts the inner surface of the tubular element 2.

The anchor 28 is provided with a primary compression spring 56 positioned between a lower flange 57 of the central body 40 and the lower ends of the slip elements 50. The primary spring 56 is arranged to push the slip elements 50 to the radially expanded mode. Furthermore, the anchor 28 is provided with a secondary compression spring 58 positioned between an upper flange 59 of the central body 40 and a stop member 60 against which the slip elements 50 are pushed by the primary spring 56. The stop member is formed by a cylinder 60 of a hydraulic actuator 62, the cylinder 60 being movable in axial direction in correspondence with movement of the slip elements 50 between the retracted mode and the expanded mode. The secondary compression spring 58 has a higher pre-load than the primary compression spring 56 so that the resulting spring force acting on the slip elements 50 induces the slip elements 50 to move to the retracted mode when the hydraulic actuator 62 is inactive. The hydraulic actuator 62 includes a piston 63 axially movable in the cylinder 60. Further, the hydraulic actuator is in fluid communication with the fluid channel 42 via a side opening 64 in the central body 40 so that the cylinder moves in upward direction relative to the piston upon application of fluid pressure in the fluid channel 42.

Figure 6A:
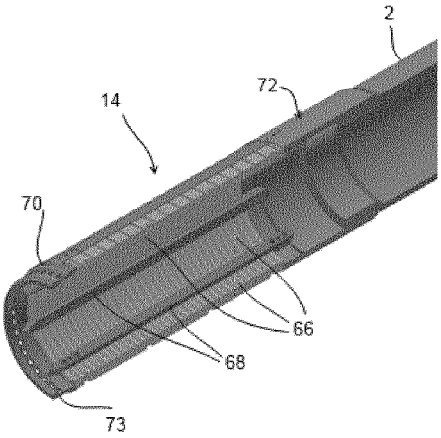
FIGS. 6*a, b* schematically show the cage used in the embodiment, seen in longitudinal section and perspective view.
Figure 6B:
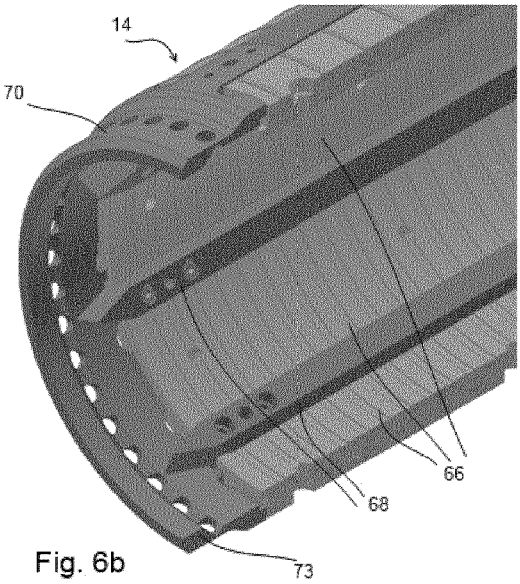

Referring further to FIGS. 6*a, b* there is shown a longitudinal section of the cage 14 in more detail, seen in perspective view. The cage 14 has a tubular shape with an inner diameter allowing the anchor 28 to be received into the cage 14. For each slip element 50, the cage 14 comprises a respective slip extension member 66 arranged so that when the anchor 28 is received into the cage 14, the slip extension member 66 is located opposite the slip element 50. Each slip extension member 66 is held in place between a pair of axial strips 68 in a manner allowing the slip extension member 66 to move in radial direction and against the inner surface of the casing 6. The cage 14 further comprises upper and lower ring members 70, 72 that are interconnected by the strips 68. The lower ring member 72 is temporarily connected to the upper end of the tubular element 2 by one or more shear pins (not shown). The upper ring member 70 is provided with an annular internal upset 73 of inner diameter smaller than the outer diameter of the flange 59 of the central body 40 of the anchor 28. Each strip 68 has a lower end portion tapering in downward direction to promote the anchor 28 to be received into the cage 14.

Normal operation of the system 1 is as follows. The expansion string 16 and the tubular element 2 are simultaneously lowered through the casing 6 and into an open borehole section below the casing, whereby the tubular element 2 is supported by the expander 27. To maintain wellbore control during lowering, drilling fluid may be circulated in the borehole via the fluid channel 42, the bore 36 of the piston, the cylinder 34, and the flow passage 44 of the expander. After lowering to the required depth, whereby the short overlap section 12 of tubular element 2 and casing 6 is present, expansion of the tubular element 2 may be started (FIGS. 1, 5*a*).

Figure 2:
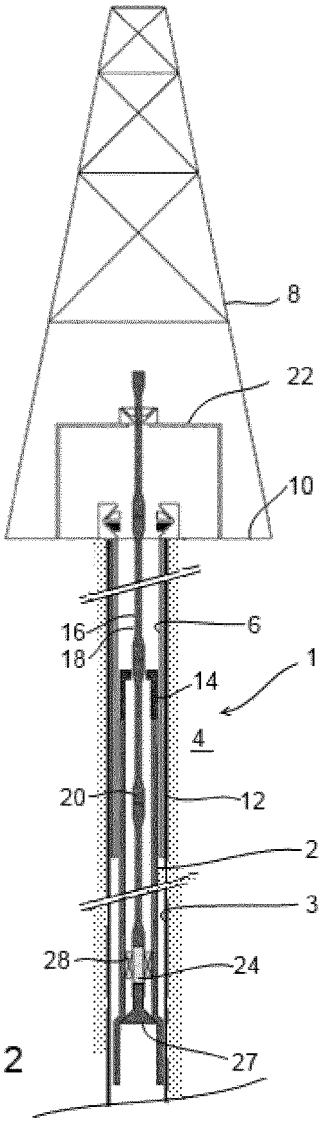
FIG. 2 schematically shows the embodiment after an initial stage of expansion of the tubular element.
Figures 5C, 5D, 5E:
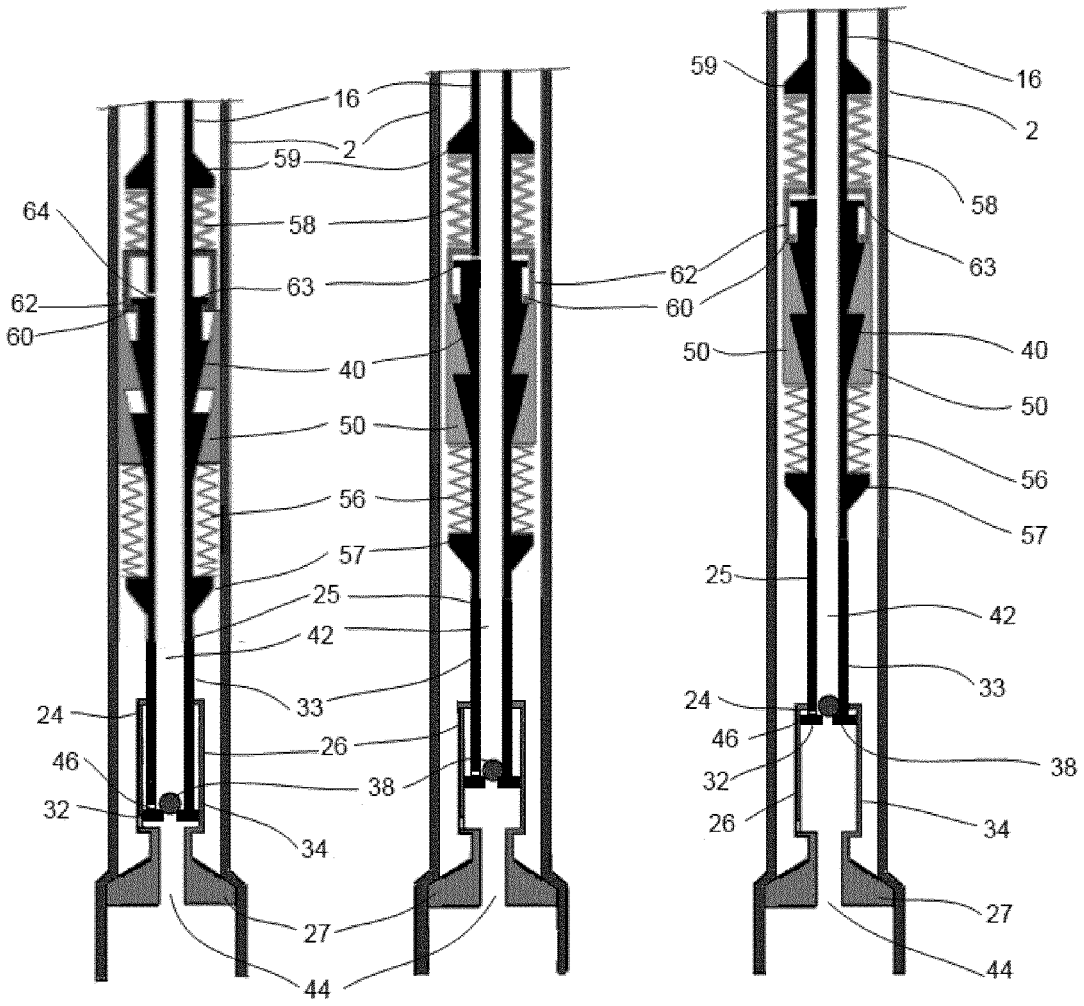

During an initial stage of the expansion process the plug 38 is pumped in a stream of hydraulic fluid through the fluid channel 42 of the expansion string 16 until the plug closes the bore 36 of piston 32. Pumping of hydraulic fluid through the fluid channel 42 is then proceeded so that hydraulic fluid is pumped into the cylinder 34 of the jack device 24 via the side opening 46 of the mandrel 33, and into the hydraulic actuator 62 of the anchor 28 via the side opening 64 of the central body 40. As a result the cylinder 60 moves in upward direction against the force of the secondary spring 58 and thereby allows the primary spring 56 to push the slip elements 50 to the expanded mode so that the anchor 28 becomes activated. With the anchor 28 activated, the increased fluid pressure in the cylinder 34 causes the jack device 24 to stroke in whereby the cylinder 34 moves upwardly relative to the mandrel 33 and thereby pulls the expander 27 into the tubular element 2. A lower portion of the tubular element is thereby expanded (FIGS. 2, 5*b*, 5*c*).

Figure 3:
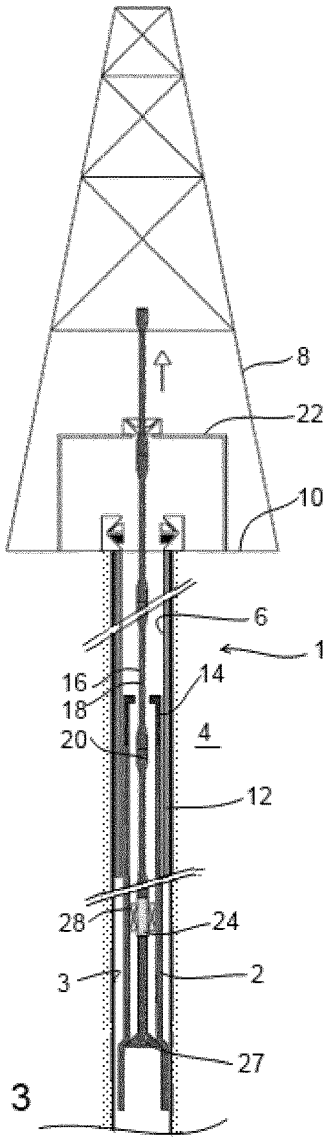
FIG. 3 schematically shows the embodiment after a further stage of expansion of the tubular element.
Figure 4:
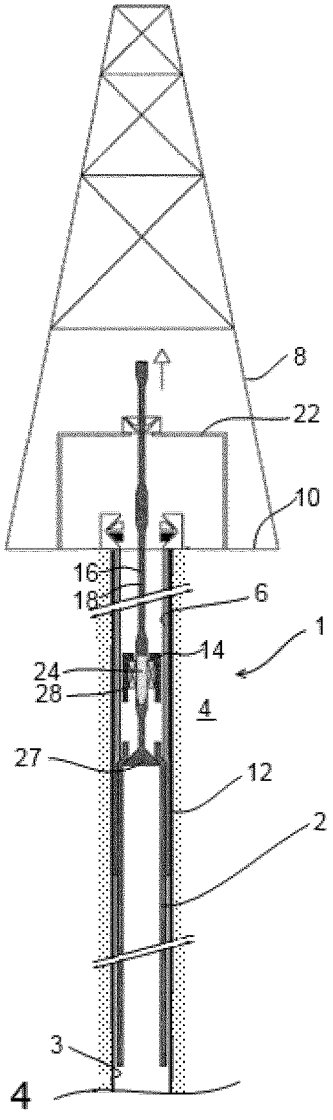
FIG. 4 schematically shows the embodiment during a final stage of expansion of the tubular element.

During a further stage of the expansion process, after the jack device 24 has fully stroked in, the fluid pressure in the fluid channel 42 is released so that, as a result, the hydraulic actuator 62 is deactivated thereby allowing the secondary spring 58 to push the slip elements 50 via the cylinder 60 back to the radially retracted mode. In a next step the expansion string 16 is pulled upwardly in order to fully stroke out the jack device 24 (FIGS. 3, 5*d*, 5*e*).

Thus, one cycle of the expansion process includes the steps of activating the anchor 28, stroking the jack device 24 in to radially expand a section of the tubular element 2, deactivating the anchor 28, and pulling the expansion string 16 upwardly. The cycle is repeated as many times as necessary to fully expand the tubular element 2.

As the anchor 28 reaches the top of the tubular element 2, pulling the expansion string 16 further upwardly causes the anchor 28 to enter into the cage 14. The expansion cycle is then repeated whereby during activation of the anchor 28, the slip elements 50 of the anchor push the respective slip extension members 66 against the inner surface of the casing 6. In this manner the anchor 28 is anchored to the casing 6 thereby allowing the jack device 24 to pull the expander 27 through the upper end portion of the tubular element 2. At the end of this expansion cycle the expansion string 16 is pulled upwardly whereby the flange 59 of the anchor moves against the internal upset 73 of the cage 14 so that the shear pin of the cage shears off. Thereafter the cage 14 remains attached to the anchor 28 and moves upwardly with the anchor during the final cycles of the expansion process. Once the tubular element 2 has been fully expanded, the expansion string 16 together with the cage 14 is removed from the borehole 3.

If desired an upward pulling force may be applied to the expansion string 16 during stroking in of the jack device 24 in order to supplement the holding power of the anchor 28. This may be especially useful during expansion of the tubular element in the overlap section 12, when the tubular element 2 and the casing 6 are expanded simultaneously.

The present invention is not limited to the embodiments as described above. Various modifications are conceivable within the scope of the appended claims. Features of respective embodiments for instance may be combined.

We claim:

1. An anchor system for anchoring a tool in a tubular element within an underground borehole, the anchor system comprising:

an anchor having a central body connected to the tool or integrally formed with the tool;

a slip element radially movable relative to the central body between a retracted position, wherein the slip element is retracted from an inner surface of the tubular element, and an expanded position, wherein the slip element engages the inner surface of the tubular element;

primary spring means arranged to induce movement of the slip element to the expanded position;

a control device for controlling movement of the slip element induced by the primary spring means, which control device comprises a stop member against which the slip element is pushed by the primary spring means, the stop member being movable in correspondence with movement of the slip element between the retracted position and the expanded position; and secondary spring means configured to act on the stop member so as to induce movement of the slip element to the retracted position.

2. The system of claim 1, wherein the slip element is movable to the retracted position as induced by the resulting spring force acting on the slip element.

3. The system of claim 1, wherein the primary spring means comprises a primary compression spring and the secondary spring means comprises a secondary compression spring, the secondary compression spring having a higher pre-load than the primary compression spring when the at least one slip element is in the retracted position.

4. The system of claim 1, wherein the control device comprises a hydraulic actuator arranged to control movement of the stop member.

5. The system of claim 4, wherein the central body is included in an elongate string extending from surface into the tubular element, and wherein the hydraulic actuator is adapted to be operated by a hydraulic control system at a surface position via a fluid channel extending in the elongate string.

6. The system of claim 5, wherein the tool is adapted to be operated by the hydraulic control system at the surface position via the fluid channel extending in the elongate string.

7. The system of claim 5, wherein the tubular element is a radially expandable tubular element, and wherein the tool comprises a jack device for pulling an expander through the tubular element so as to radially expand the tubular element.

8. The system of claim 7, wherein a cage is positioned above the tubular element, the cage being surrounded by a cylindrical wall and being adapted to receive the anchor and to be radially expanded by the anchor against said cylindrical wall.

9. The system of claim 8, wherein the system comprises a plurality of slip elements and the cage comprises, for each slip element, a respective slip extension member arranged to be moved by the slip element in radially outward direction against the cylindrical wall.

10. A method of anchoring a tool in a tubular element extending in a borehole formed in an earth formation, wherein use is made of an anchor system the comprises:

an anchor having a central body connected to the tool or integrally formed with the tool;

a slip element radially movable relative to the central body between a retracted position: wherein the slip element is retracted from an inner surface of the tubular element and an expanded position; wherein the slip element engages the inner surface of the tubular element;

primary spring means;

secondary spring means, and a control device; wherein the method further comprises:

radially moving the slip element relative to the central body between said retracted position and said expanded position whereby inducing such movement by the primary spring means;

controlling movement of the slip element induced by the primary spring means by means of the control device, which control device comprises a stop member against which the slip element is pushed by the primary spring means, the stop member being movable in correspondence with movement of the slip element between the retracted position and the expanded position; and secondary spring means acting on the stop member so as to induce movement of the slip element to the retracted position.

* * * * *